US005565043A

United States Patent [19]

Akioka et al.

[11] Patent Number: 5,565,043

[45] **Date of Patent: *Oct. 15, 1996**

[54] RARE EARTH CAST ALLOY PERMANENT MAGNETS AND METHODS OF PREPARATION

[75] Inventors: Koji Akioka; Osamu Kobayashi; Tatsuya Shimoda; Toshiyuki Ishibashi; Ryuichi Ozaki, all of Nagano-ken, Japan

[73] Assignee: Seiko Epson Corporation, Tokyo, Japa

[ * ] Notice: The term of this patent shall not extend beyond the expiration date of Pat. No. 5,213,631.

[21] Appl. No.: 265,474

[22] Filed: Jun. 24, 1994

Related U.S. Application Data

[63] Continuation of Ser. No. 82,190, Jun. 24, 1993, and a continuation-in-part of Ser. No. 34,009, Mar. 19, 1993, which is a continuation-in-part of Ser. No. 760,555, Sep. 16, 1991, abandoned, and Ser. No. 730,399, Jul. 16, 1991, abandoned, which is a continuation of Ser. No. 577,830, Sep. 4, 1990, abandoned, which is a continuation of Ser. No. 346,678, May 3, 1989, abandoned, which is a continuation of Ser. No. 895,653, Aug. 12, 1986, abandoned, said Ser. No. 82,190, is a continuation-in-part of Ser. No. 670,828, Mar. 18, 1991, abandoned, which is a division of Ser. No. 524,687, May 14, 1990, abandoned, which is a continuation of Ser. No. 101,608, Sep. 28, 1987, abandoned.

[30] Foreign Application Priority Data

| | | | |
|---|---|---|---|
| Aug. 13, 1985 | [JP] | Japan | 60-178113 |
| Feb. 7, 1986 | [JP] | Japan | 61-25437 |
| Feb. 13, 1986 | [JP] | Japan | 61-29501 |
| Mar. 2, 1987 | [JP] | Japan | 62-047042 |
| Apr. 30, 1987 | [JP] | Japan | 62-104623 |

[51] Int. Cl.[6] ..... H01F 1/053

[52] U.S. Cl. ..... 148/302; 420/83; 420/121

[58] Field of Search ..... 148/302; 420/83, 420/121

[56] References Cited

U.S. PATENT DOCUMENTS

| | | | |
|---|---|---|---|
| 4,475,961 | 10/1984 | Jin | 148/120 |
| 4,536,233 | 8/1985 | Okonogi et al. | 148/101 |
| 4,664,724 | 5/1987 | Mizoguchi et al. | 148/302 |

(List continued on next page.)

FOREIGN PATENT DOCUMENTS

| | | |
|---|---|---|
| 0092422 | 10/1983 | European Pat. Off. . |
| 0092423 | 10/1983 | European Pat. Off. . |
| 0101552 | 2/1984 | European Pat. Off. . |

(List continued on next page.)

OTHER PUBLICATIONS

Boltich et al., "Magnetic Characteristics of $R_2Fe_{14}B$ Systems Prepared with High Purity Rare Earths," Journal of Applied Physics, vol. 57, No. 1, Part 2B, pp. 4106–4108, Apr. 15, 1985.

Cedighian, "Die Magnetischen Werkstoffe," VDI Verlag, Dusseldorf, pp. 28–35, 1973.

(List continued on next page.)

*Primary Examiner*—George Wyszomierski

*Attorney, Agent, or Firm*—Stroock & Stroock & Lavan

[57] ABSTRACT

A rare earth iron permanent magnet including at least one rare earth element, iron and boron as primary ingredients. The magnet can have an average grain diameter of less than or equal to about 150 μm and a carbon content of less than or equal to about 400 ppm and a oxygen content of less than or equal to about 1000 ppm. The permanent magnet is prepared by casting a molten alloy. In one embodiment, the cast body is heat treated at a temperature of greater than or equal to about 250° C. Alternatively, the material can be cast and hot worked at a temperature of greater than or equal to about 500° C. Finally, the material can be cast, hot worked at a temperature of greater than or equal to about 500° C. and then heat treated at a temperature of greater than or equal to about 250° C. The magnets provided in accordance with the invention are relatively inexpensive to produce an have excellent performance characteristics.

34 Claims, 3 Drawing Sheets

U.S. PATENT DOCUMENTS

| | | | |
|---|---|---|---|
| 4,756,775 | 7/1988 | Croat | 148/302 |
| 4,767,474 | 8/1988 | Fujimura et al. | 148/302 |
| 4,840,684 | 6/1989 | Fujimura et al. | 148/302 |
| 4,842,656 | 6/1989 | Maines | 148/302 |
| 4,853,045 | 8/1989 | Rozendaal | 148/103 |
| 4,902,361 | 2/1990 | Lee et al. | 148/302 |
| 4,921,551 | 5/1990 | Vernia et al. | 148/101 |
| 4,921,553 | 5/1990 | Tokunaga | 148/302 |
| 4,952,239 | 8/1990 | Tokunaga | 148/302 |
| 4,983,232 | 1/1991 | Endoh | 148/302 |
| 4,985,085 | 1/1991 | Chatterjee | 148/101 |
| 5,049,208 | 9/1991 | Yajima | 148/302 |
| 5,055,142 | 10/1991 | de la Bathie et al. | 148/101 |
| 5,213,631 | 5/1993 | Akioka et al. | 148/302 |

FOREIGN PATENT DOCUMENTS

| | | |
|---|---|---|
| 0108474 | 5/1984 | European Pat. Off. . |
| 0106948 | 5/1984 | European Pat. Off. . |
| 0126179 | 11/1984 | European Pat. Off. . |
| 0125752 | 11/1984 | European Pat. Off. . |
| 0134305 | 3/1985 | European Pat. Off. . |
| 0133758 | 3/1985 | European Pat. Off. . |
| 0134304 | 3/1985 | European Pat. Off. . |
| 0144112 | 6/1985 | European Pat. Off. . |
| 0153744 | 9/1985 | European Pat. Off. . |
| 0175214 | 3/1986 | European Pat. Off. . |
| 0174735 | 3/1986 | European Pat. Off. . |
| 0184722 | 6/1986 | European Pat. Off. . |
| 0187538 | 7/1986 | European Pat. Off. . |
| 2586323 | 2/1987 | France . |
| 56-047538 | 4/1981 | Japan . |
| 59-132105 | 7/1984 | Japan . |
| 59-222564 | 12/1984 | Japan . |
| 60-063304 | 4/1985 | Japan . |
| 60-152008 | 8/1985 | Japan . |
| 60-281457 | 11/1985 | Japan . |
| 61-139603 | 6/1986 | Japan . |
| 61-119005 | 6/1986 | Japan . |
| 61-225814 | 10/1986 | Japan . |
| 61-238915 | 10/1986 | Japan . |
| 61-268006 | 11/1986 | Japan . |
| 62-47455 | 3/1987 | Japan . |
| 62-047455 | 3/1987 | Japan . |
| 62-101004 | 5/1987 | Japan . |
| 62-216203 | 9/1987 | Japan . |
| 62-198103 | 9/1987 | Japan . |
| 62-203302 | 9/1987 | Japan . |
| 62-203303 | 9/1987 | Japan . |
| 62-213102 | 9/1987 | Japan . |
| 63-114106 | 5/1988 | Japan . |
| 63-287005 | 11/1988 | Japan . |
| 1-171207 | 7/1989 | Japan . |
| 1-208811 | 8/1989 | Japan . |
| 2-007505 | 1/1990 | Japan . |
| 2-101710 | 4/1990 | Japan . |
| 2206241 | 12/1988 | United Kingdom . |
| WO80/01857 | 9/1990 | WIPO . |

OTHER PUBLICATIONS

Chin et al., "(FeCo)–Nd–B Permament Magnets By Liquid Dynamic Compaction," J. Appl. Phys. 59(4), Feb. 15, 1986, pp. 1297–1300.

Koch et al., "Valvo Permanentmagnete I," Verlag Boysen und Maarsch Hamburg, pp. 57–59, 1983.

Kononnko et al., "Effect of Heat Treatment on the Coercive Force of Neodymium–Iron–Boron Alloy Magnets," Chemical Abstracts, vol. 104, No. 24, p. 705, Jun. 1986—Disclosed in U.S. patent application Ser. No. 07/760,555, filed Sep. 16, 1991.

Lee, "Hot–Pressed Neodymium–Iron–Boron Magnets," Appl. Phys. Lett. 46(8), Apr. 15, 1985, pp. 790–791.

Maocai et al., "Effects of Additive Elements on Magnetic Properties of Sintered Nd–B–Fe Magnet," Paper No. VIII–5, 8th International Workshop on Rare–Earth Magnets and their Applications, Dayton, Ohio, May 6–8, 1985, pp. 541–553.

Miho, "Intrinsic Coercivity of Cast–Type Nd–Fe–B Series Alloy Magnet"—Disclosed in U.S. patent application Ser. No. 07/730,399, filed Jul. 16, 1991.

L'Heritier et al., "Magnetisme," Comptes Rendus Acad. Sci. Serie C. Sciences Chimiques, vol. 299, No. 13, Nov., 1984, pp. 849–852.

Sagawa et al., "New Material for Permanent Magnets on a Base of Nd and Fe (invited)," J. Appl. Phys. 55(6), Mar. 15, 1984, pp. 2083–2087.

Shimoda et al., "High–Energy Cast Pr–FE–B Magnets," J. Appl. Phys. 64(10), Nov. 15, 1988, pp. 5290–5292.

ROLLING PROCESS

STAMPING PROCESS

RARE EARTH CAST ALLOY PERMANENT MAGNETS AND METHODS OF PREPARATION

CROSS REFERENCE TO RELATED APPLICATIONS

This is a) a continuation of U.S. Ser. No. 08/082,190, filed Jun. 24, 1993, which is continuation-in-part of Ser. No. 07/670,828, filed Mar. 18, 1991 (abandoned), which is a division of Ser. No. 07/524,687, filed May 14, 1990 (abandoned), which is a continuation of Ser. No. 07/101,608, filed Sep. 28, 1987 (abandoned), and (b) a continuation-in-part of Ser. No. 08/034,009, filed Mar. 19, 1993, which is (i) a continuation-in-part of Ser. No. 07/760,555, filed Sep. 16, 1991 (abandoned) and is (ii) also a continuation-in-part of Ser. No. 07/730,399, filed Jul. 16, 1991 (abandoned), which is a continuation of Ser. No. 07/577,830, filed Sep. 4, 1990 (abandoned), which is a continuation of Ser. No. 07/346,678, filed May 3, 1989 (abandoned), which is a continuation of Ser. No. 06/895,653, filed Aug. 12, 1986 (abandoned).

BACKGROUND OF THE INVENTION

The invention relates generally to permanent magnets and more particularly to permanent magnets including rare earth elements, iron and boron as primary ingredients and improved methods of making those magnets.

Permanent magnets are important electronic materials and are used in a wide variety of fields ranging from household electrical appliances to peripheral console units of large computers. Higher performance standards have recently been required in permanent magnets. The demand for such magnets has also grown in proportion to the demand for small, high efficiency electrical appliances.

Typical known and commonly used permanent magnets include alnico magnets, hard ferrite and rare earth element—transition metal magnets. Rare earth element—transition magnets such as R-Co and R-Fe-B magnets provide particularly good magnetic performance.

Several methods have been developed for manufacturing rare earth iron based permanent magnets. These methods include:

1. A sintering method based on powder metallurgy techniques;
2. A resin bonding technique using rapidly quenched ribbon fragments having thicknesses of about 30μ. The ribbon fragments are prepared using a melt spinning apparatus of the type used for producing amorphous alloys; and
3. A two-step hot pressing technique in which mechanical alignment treatment is performed on rapidly quenched ribbon fragments prepared using a melt spinning apparatus.

The sintering method is described in Japanese Patent Laid-Open Application No. 46008/1984 and in an article by M. Sagawa, S. Fujimura, N. Togawa, H. Yamamoto and Y. Matushita that appeared in Journal of Applied Physics, Vol. 55(6), p. 2083 (Mar. 15, 1984). As described therein, an alloy ingot is made by melting and casting. The ingot is pulverized to a fine magnetic powder having a particle diameter of about 3 μm. The magnetic powder is kneaded with a binder such as a wax which functions as a molding additive. The kneaded magnetic powder is press molded in a magnetic field in order to obtain a molded body. The molded body, called a "green body", is sintered in an argon atmosphere for one hour at a temperature between about 1000° and 1100° C. and the sintered body is quenched to room temperature. Then the sintered body is heat treated at about 600° C. in order to increase further the intrinsic coercivity of the body.

The sintering method requires pulverization of the alloy ingot to a fine powder. However the R-Fe-B series alloy wherein R is a rare earth element is extremely reactive in the presence of oxygen. Thus, the alloy powder is easily oxidized when the oxygen concentration of the sintered body is increased to an undesirable level. When the kneaded magnetic powder is molded, wax or additives such as, for example, zinc stearate are required. While efforts have been made to eliminate the wax or additive prior to the sintering process, some of the wax or additive inevitably remains in the magnet in the form of carbon, which causes deterioration of the magnetic performance of the R-Fe-B alloy magnet.

Following the addition of the wax or molding additive and the press molding, the green or molded body is fragile and difficult to handle. Accordingly, it is difficult to place the green body into a sintering furnace without breakage and this is a major disadvantage of the sintering method. As a result of these disadvantages, expensive equipment is necessary in order to manufacture R-Fe-B series magnets according to the sintering method. Additionally, productivity is low and manufacturing costs are high. Therefore, the potential benefits of using inexpensive raw materials of the type required are not realized.

The resin bonding technique using rapidly quenched ribbon fragments is described in Japanese Patent Laid-Open Application No. 211549/1984 and in an article by R. W. Lee that appeared in Applied Physics Letters, Vol. 46 (8), p. 790 (Apr. 15, 1985). Ribbon fragments of R-Fe-B alloy are prepared using a melt spinning apparatus spinning at an optimum substrate velocity. The fragments are ribbon shaped, have a thickness of up to 30 μm and are aggregations of grains having a diameter of less than about 1000 Å. The fragments are fragile and magnetically isotropic, because the grains are distributed isotopically. The fragments are crushed to yield particles of a suitable size to form the magnet. The particles are then kneaded with resin and press molded at a pressure of about 7 ton/cm$^2$. Reasonably high densities (–85 vol %) have achieved at the pressure in the resulting magnet.

The vacuum melt spinning apparatus used to prepare the ribbon fragments is expensive and relatively inefficient. The crystals of the resulting magnet are isotropic resulting in low energy product and a non-square hysteresis loop. Accordingly, the magnet has undesirable temperature coefficients and is impractical.

Alternatively, the rapidly quenched ribbon or ribbon fragments are placed into a graphite or other suitable high temperature die which has been preheated to about 700° C. in a vacuum or inert gas atmosphere. When the temperature of the ribbon or ribbon fragments has risen to 700° C., the ribbons or ribbon fragments are subjected to uniaxitial pressure. It is to be understood that the temperature is not strictly limited to 700° C., and it has been determined that temperatures in the range of 725° k.±25° C. and pressures of approximately 1.4 ton/cm$^2$ are suitable for obtaining magnets with sufficient plasticity. Once the ribbons or ribbon fragments have been subjected to uniaxitial pressure, the grains of the magnet are slightly aligned in the pressing direction, but are generally isotropic.

A second hot pressing process is performed using a die with a larger cross-section. Generally, a pressing temperature of 700° C. and a pressure of 0.7 ton/cm$^2$ are used for a period of several seconds. The thickness of the materials is reduced by half of the initial thickness and magnetic alignment is introduced parallel to the press direction. Accordingly, the alloy becomes anisotropic. By using this two-step hot pressing technique, high density anisotropic R-Fe-B series magnets are provided.

In this two-step hot pressing technique, which is described in Japanese Laid-Open Application No. 100402/1985, it is preferable to have ribbons or ribbon fragments with grain particle diameters that are slightly smaller than the grain diameter at which maximum intrinsic coercivity would be exhibited. If the grain diameter prior to the procedure is slightly smaller than the optimum diameter, the optimum diameter will be realized when the procedure is completed because the grains are enlarged during the hot pressing procedure.

The two-step hot pressing technique requires the use of the same expensive and relatively inefficient vacuum melt spinning apparatus used to prepare the ribbon fragments for the resin bonding technique. Additionally, the two-step hot working of the ribbon fragments is inefficient even though the procedure itself is unique.

Finally, a liquid dynamic compaction process (LCD process) of the type described in T. S. Chin et al., Journal of Applied Physics, Vol. 59 (4) , p. 1297 (Feb. 15, 1986) can be used to produce an alloy having a coercive force in a bulk state. However, this process also requires expensive equipment and exhibits poor productivity.

Accordingly, it is desirable to provide a method of manufacturing improved rare earth-iron series permanent magnets that minimizes the disadvantages of the prior art methods.

SUMMARY OF THE INVENTION

Generally speaking, in accordance with the invention, a cast alloy rare earth iron series permanent magnet is provided. The magnet can be formed by melting at least one rare earth element, iron and boron as primary ingredients and casting an alloy ingot from the molten material. The cast ingot can then be hot worked such as at a temperature greater than about 500° C., preferably from 800 to 1100° C. in order to make the crystal grains fine and align the axis of the grains in a desired direction. The cast ingot can also be heat treated such as at a temperature greater than about 250° C. in order to harden the ingot magnetically, either prior to or after hot working.

The resulting permanent magnet can have an average grain diameter of less than or equal to about 150 μm a carbon content of less than or equal to about 400 ppm and an oxygen content of less than or equal to about 1000 ppm and have anisotropic properties. The magnet will preferably have an average grain diameter greater than about 3 μm.

In a preferred embodiment, the permanent magnet is a cast alloy of between about 8 and 30 atomic percent of at least one rare earth element, between about 2 and 28 percent atomic percent boron with the balance iron. The ingot can also include between 0 and 50 atomic percent cobalt and less than about 15 atomic percent aluminum together with inevitable impurities which become incorporated during the preparation process. Cu, Cr, Si, Mo, W, Nb, Ta, Zr, Hf and Ti can also be added, preferrably in an amount from 2 to 15 at %.

Generally speaking, in accordance with the invention, cast alloy rare earth iron series permanent magnet is provided The magnet can be formed by melting at least one rare earth element, iron and boron as primary ingredients, an average grain diameter of less than or equal to about 150 μm, a carbon content of less than or equal to about 400 ppm and an oxygen content of less than or equal to about 1000 ppm is provided.

Accordingly, it is an object of the invention to provide high performance permanent magnets containing rare earth and transition metals.

Another object of the invention is to provide high performance permanent magnets at relatively low cost.

A further object of the invention is to provide a method of manufacturing high performance rare earth-iron series permanent magnets.

Still other objects and advantages of the invention will in part be obvious and will in part be apparent from the specification and drawings.

The invention accordingly comprises the several steps and the relation of one or more of such steps with respect to each of the others, and the permanent magnet possessing the features, properties and the relation of elements, which are exemplified in the following detailed disclosure, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
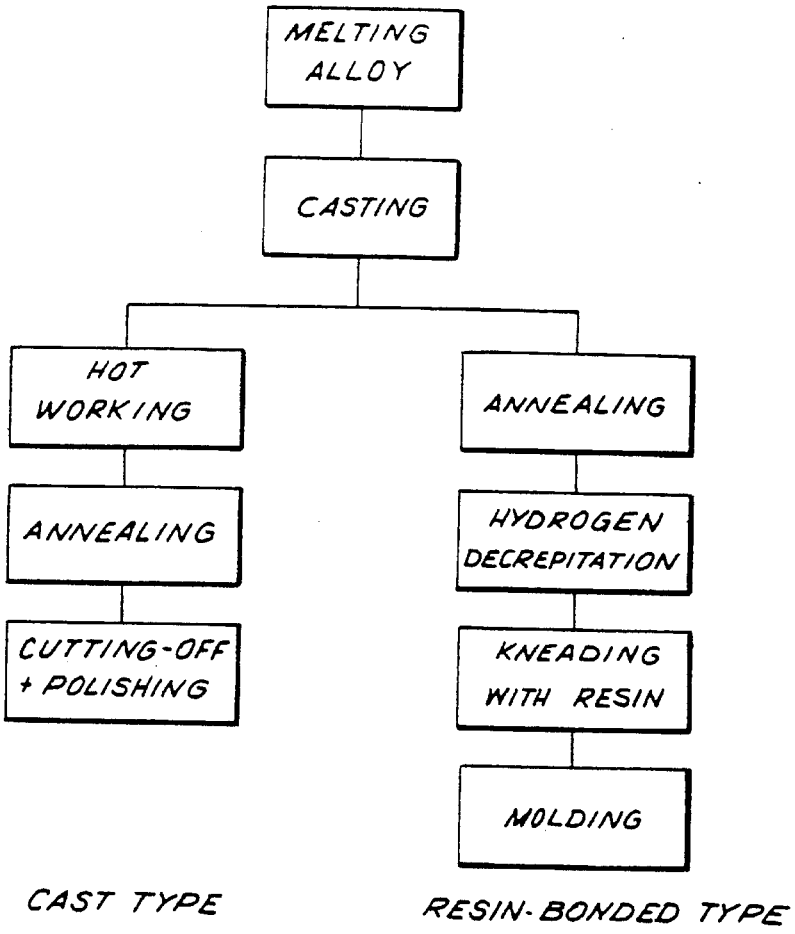
FIG. 1 is a flow diagram showing the steps of a method of manufacturing a rare earth iron series magnet in accordance with the invention.

Permanent magnets prepared in accordance with the invention can include between about 8 and 30 atomic % of at least one rare earth element, preferably between about 8 and 25 at %, between about 8 and 25 atomic % boron, preferably between 2 and 8%, more preferably from about 2 to 6% B and the balance iron. The magnets can also include between 0 and 50 at % Co and/or between 0 and 15 at % Al. Copper can also be included, preferably in an amount between 0 and 6%, more preferably between 0.1 and 3%. The rare earth element component includes at least one Lanthanide series element such as yttrium (Y), lanthanum (La), cerium (Ce), praseodymium (Pr), neodymium (Nd), promethium (Pm), samarium (Sm), europium (Eu), gadolinium (Gd), terbium (Tb), dysprosium (Dy), holmium (Ho) , erbium (Er) , thulium (Tm), ytterbium (Yb) and lutetium (Lu). Neodymium and praseodymium are preferred.

In addition to the rare earth element, iron and boron, the permanent magnet may also contain minor amounts of impurities which are inevitably introduced during the manufacturing process. Cobalt can be added and can raise the Curie temperature. Co should be included in an amount up to about 50 atomic %, preferably less than 40% and more preferably between about 2 and 15 atomic percent. In addition, one or more of aluminum, chromium, silicon, molybdenum, tungsten, niobium, tantalum, zirconium, hafnium, titanium and the like can be added. These can increase the coercive force (intrinsic coercivity) of the magnet. Generally, between about 2 and 15 atomic % and preferably between about 0.5 and 5 atomic % is added.

The main phase of an R-Fe-B series magnet is $R_2Fe_{14}B$. When R is less than about 8 atomic percent, the $R_2Fe_{14}B$ compound does not emerge. In such a case, a body centered cubic structure having the same structure as α-iron emerges and good magnetic properties are not obtained. In contrast, when R is greater than about 30 atomic percent, the number of non-magnetic R-rich phases increases and magnetic properties are deteriorated significantly. Accordingly, a preferred range of the amount of R is between about 8 and 30 atomic percent. In the case of a cast magnet the range of R is more preferably between about 8 and 25 atomic percent.

Boron (B) causes the $R_2Fe_{14}B$ phase to emerge. If less than about 2 atomic percent of B is used, the rhombohedral R-Fe series does emerge and high intrinsic coercivity is not obtained. However, as shown in magnets produced by sintering method of the prior art, if B is included an amount of greater than about 28 atomic percent, non-magnetic B-rich phases increase the residual magnetic flux density is reduced. Accordingly, the upper limit of the desirable amount of B for the sintered magnet is about 28 atomic percent. If B is greater than about 8 atomic percent, however, a fine $R_2Fe_{14}B$ phase is not obtained unless specific cooling is performed and, even this case, intrinsic coercivity is low. Accordingly, B is more preferably in the range between about 2 and 8 atomic percent, especially when the alloy is to be used to prepare a cast magnet.

Cobalt (Co) is effective to enhance the Curie point and can be substituted at the site of the Fe element to produce $R_2Co_{14}B$. However, the $R_2Co_{14}B$ compound has a small crystalline anisotropy field. The greater the quantity of the $R_2Co_{14}B$ compound, the lower the intrinsic coercivity of the magnet. Accordingly, in order to obtain a coercivity of greater than about 1 kOe, which is considered sufficient for a permanent magnet, Co should be present in an amount less than about 50 atomic percent.

Aluminum (Al) increases the intrinsic coercivity of the resulting magnet. This effect is described in Zhang Maocai et al., Proceedings of the 8th International Workshop on Rare-Earth Magnets, p. 541 (1985). The Zhang Maocai et al reference refers only to the effect of aluminum in sintered magnets. However, the same effect is observed in cast magnets.

Since aluminum is a non-magnetic element, if the amount of aluminum is large, the residual magnetic flux density decreases to an unacceptable level. If more than about 15 atomic percent of aluminum is used, the residual magnetic flux density is reduced to the level of hard ferrite. Accordingly, a high performance rare-earth magnet is not achieved. Therefore, the amount of aluminum should be less than about 15 atomic percent.

The amount of iron (Fe), the main constituent, should be between about 42 and 90 atomic percent. If the amount of Fe is less than about 42 atomic percent, the residual magnetic flux density can be lowered to an unacceptable level. On the other hand, if the amount of iron is greater than about 90 atomic percent, high intrinsic coercivity is not observed.

As discussed above, each of the prior art methods for preparing a rare earth-iron series permanent magnet has disadvantages. For example, in the sintering method it is difficult to handle the powder, while in the resin-bonding technique using quenched ribbon fragments, productivity is poor. In order to eliminate these disadvantages, magnetic hardening the bulk state has been studied with the following conclusions:

1. A fine grain, anisotropic alloy can be prepared by hot working an alloy composition consisting of between about 8 and 30 atomic percent of R, between about 2 and 28 atomic percent of B, less than about 50 atomic percent of Co, less than about 15 atomic percent of Al and the balance of Fe and other impurities that are inevitably included during the preparation process.
2. A magnet with sufficient intrinsic coercivity can be obtained by heat treating a cast ingot having an alloy composition containing between about 8 and 25 atomic percent of R, between about 2 and 8 atomic percent of B, less than about 50 atomic percent of Co, less than about 15 atomic percent of Al and the balance of Fe and other impurities that are inevitably included during the preparation process.
3. An anisotropic resin-bonded magnet can be obtained by pulverizing a hot worked cast ingot consisting of between about 8 and 25 atomic percent of R, between 2 and 8 atomic percent of B, less than about 50 atomic percent of Co, less than about 15 atomic percent of Al and the balance of Fe and other impurities that are inevitably included during the preparation process to powders using hydrogen decrepitation, kneading the powders with an organic binder and curing the kneaded powder and binder.
4. Anisotropic resin-bonded magnets can be obtained after hot working is performed because the pulverized powders have a plurality of anisotropic fine grains. Accordingly, the ingot is formed of a plurality of anisotropic fine grains.

In accordance with the invention, a cast alloy ingot can be hot worked at a temperature greater than about 500° C. in order to make the ingot anisotropic in only one step, in contrast to the two-step hot working procedure described in the Lee reference. Hot working may be performed at a strain rate of from about $10^{-4}$ to $10^{2}$, more preferably $10^{-4}$ to 1 per second in order to obtain fine crystal grain and to align the grain axes in a desired direction. Strain rate refers to dE/dt, wherein E is the logarithmic strain E, defined by the equality: $E=l_n(l_2/l_1)$ in which $l_n$ is the natural log, $l_2$ is the length after processing and $l_1$ is the length before processing. The intrinsic coercivity of the hot worked body is increased as a result of the fineness of the grains. Since there is no need to pulverize the cast ingot, it is not necessary to control the atmosphere strictly as done in the sintering method. This greatly reduces equipment cost and increases productivity.

Another advantage of the hot working method in accordance with the invention is that the resin-bonded magnets are not originally isotropic, as is the case with magnets obtained by the usual quenching methods. Accordingly, an anisotropic resin bonded magnet is easily obtained and the advantages of a high performance, low cost R-Fe-B series magnet are realized.

A report on the magnetization of alloys in the bulk state was presented by Hiroaki Miho et al at the lecture meeting of the Japanese Institute of Metals, Autumn 1985, Lecture No. 544. The report refers to small samples having the composition $Nd_{16.2}Fe_{50.7}Co_{22.6}V_{1.3}B_{9.2}$, which is an alloy outside a preferred composition range. The composition is melted in air during exposure to an argon gas spray and is then extracted for sampling. The sample alloy grains were quenched and became fine as a result of the quenching. After studying this report, applicants are of the opinion that this fine grain was observed because of the small size of the samples taken.

It has been experimentally determined that grains of the main phase $Nd_2Fe_{14}B$ became coarse when they were cast according to an ordinary casting method. Although it is possible to make an alloy of the composition $Nd_{16.2}Fe_{50.7}Co_{22.6}V_{1.3}B_{9.2}$ anisotropic by hot working the composition, it is difficult to obtain sufficient intrinsic coercivity of the resulting body for use as a permanent magnet.

It has also been determined that in order to obtain a magnet of sufficient intrinsic coercivity by ordinary casting methods, the composition of the starting material should be a B-poor composition. A suitable B-poor alloy composition has between about 8 and 25 atomic percent of R, between about 2 and 8 atomic percent of B, less than about 50 atomic percent of Co, less than about 15 atomic percent of Al and the balance of Fe and other inevitable impurities.

The typical optimum composition of the R-Fe-B series magnet in the prior art is believed to be $R_{15}Fe_{77}B_8$ as shown in the Sagawa et al reference. R and B are richer in this composition than in the composition of $R_{11.7}Fe_{82.4}B_{5.9}$, which is the equivalent in atomic percentage to the $R_2Fe_{14}B$ main phase of the alloy. This is explained by the fact that in order to obtain sufficient intrinsic coercivity, non-magnetic R-rich and B-rich phases are necessary in addition to the main phase.

In the B-poor composition having between about 8 and 25 atomic percent of R, between about 2 and 8 atomic percent of B, less than about 50 atomic percent of Co, less than about 15 atomic percent of Al and the balance of Fe and other impurities which are inevitably included during the preparation process, the intrinsic coercivity is at a maximum when B is poorer than in ordinary compositions. Generally, such B-poor compositions exhibit a large decrease in intrinsic coercivity when a sintering method is used. Accordingly, this composition region has not been extensively studied.

When ordinary casting methods are used, high intrinsic coercivity is obtained only in the B-poor composition region. In the B-rich composition, which is the main composition region for use in the sintering method, sufficient intrinsic coercivity is not observed.

The reason that the B-poor composition region is desirable is that when either a sintering or a casting method is used to prepare the magnets in accordance with the invention, the intrinsic coercivity mechanism of the magnet arises primarily in accordance with the nucleation model. This is established by the fact that the initial magnetization curves of the magnets prepared by either method show steep rises such as, for example, the curves of conventional $SmCo_5$ type magnets. Magnets of this type have intrinsic coercivity in accordance with the single domain model. Specifically, if the grain of an $R_2Fe_{14}B$ alloy is too large, magnetic domain walls are introduced in the grain. The movement of the magnetic domain walls causes to reverse magnetization thereby decreasing the intrinsic coercivity. On the other hand, if the grain of $R_2Fe_{14}B$ is smaller than a specific size, magnetic walls disappear from the grain. In this case, since the magnetism can be reversed only by rotation of the magnetization, the intrinsic coercivity is decreased.

In order to obtain sufficient coercivity, the $R_2Fe_{14}B$ phase is required to have an adequate grain diameter, specifically about 10 μm. When the sintering method is used the grain diameter can be adjusted by adjusting the powder diameter prior to sintering. However, when a resin-bonding technique is used, the grain diameter of the $R_2Fe_{14}B$ compound is determined when the molten alloy solidifies. Accordingly, it is necessary to control the composition and solidification process carefully.

The composition of the alloy is particularly important. If more than 8 atomic percent of B is included, it is extremely likely that the grains of the $R_2Fe_{14}B$ phase in the magnet after casting will be larger than 100 μm. Accordingly, it is difficult to obtain sufficient intrinsic coercivity in the cast state without using quenched ribbon fragments of the type shown in the Lee et al reference. In contrast, when a B-poor composition is used, the grain diameter can be reduced by adjusting the type of mold, molding temperature and the like. In either case, the grains of the main phase $R_2Fe_{14}B$ can be made finer by performing a hot working step and accordingly, the intrinsic coercivity of the magnet is increased.

The alloy composition ranges in which sufficient intrinsic coercivity is observed in the cast state, specifically, the B-poor composition can also be referred to as the Fe-rich composition. In the solidifying state, Fe first appears as the primary phase and then $R_2Fe_{14}B$ appears as a result of the peritectic reaction. Since the cooling speed is much greater than the speed of the equilibrium reaction, the sample is solidified in such a way that the $R_2Fe_{14}B$ phase surrounds the primary Fe phase. Since the composition region is B-poor, the B-rich phase of the type seen in the $R_{15}Fe_{77}B_8$ magnet, which is a typical composition suitable for the sintering method, is small enough to be of no consequence. The heat treatment of the B-poor alloy ingot causes the primary Fe phase to diffuse and an equilibrium state to be achieved. The intrinsic coercivity of the resulting magnet depends to a great extent on iron diffusion.

A resin-bonded magnet prepared by resin-bonded quenched ribbon fragments is shown in the Lee reference. However, since the powder obtained using the quenching method consists of an isotropic aggregation of polycrystals having a diameter of less than about 1000 Å, the powder is magnetically isotropic. Accordingly, an anisotropic magnet cannot be suitably obtained and the low cost, high performance advantages of the R-Fe-B series magnet cannot be suitably achieved using the technique of resin-bonding quenched ribbon fragments.

When the R-Fe-B series resin-bonded magnet is prepared in accordance with the invention, the intrinsic coercivity is maintained at a sufficiently high level by pulverizing the hot worked cast alloy ingot to fine particles by hydrogen decrepitation. Hydrogen decrepitation causes minimal mechanical distortion and accordingly, resin-bonding can be achieved. The greatest advantage of this method is that an anisotropic magnet can be prepared by resin-bonding grains that are initially anisotropic.

When the alloy composition is pulverized to fine particles by hydrogen decrepitation, hydrogenated compounds are produced due to the particle alloy composition employed. The pulverized anisotropic fine particles are kneaded with an organic binder and cured to obtain the anisotropic resin-bonded magnet.

In order to obtain a resin bonded magnet by pulverizing an alloy ingot, the alloy ingot should be one wherein the grain size can be made fine by hot working. It is to be understood that each grain of the powder includes a plurality of magnetic $R_2Fe_{14}B$ grains even after pulverization, kneading with an organic binder and curing to obtain a resin bonded magnet.

There are two reasons why a resin-bonded R-Fe-B series magnet should be prepared only by performing a pulverizing step in accordance with the invention. First, the critical radius of the single domain of the $R_2Fe_{14}B$ compound is significantly smaller than that of the $SmCo_5$ alloy used to prepare conventional samarium-cobalt magnets and the like and is on the order of submicrons. Accordingly, it is extremely difficult to pulverize material to such small grain diameters by ordinary mechanical pulverization. Furthermore, the powder obtained is activated easily and consequently, is easily oxidized and ignited. Therefore, the intrinsic coercivity of the resulting magnet is low in comparison to the grain diameter. Applicants have studied the relationship between grain diameter and intrinsic coercivity and determined that intrinsic coercivity was a few kOe at most and did not increase even when surface treatment of the magnet was performed.

A second problem is damage to crystals caused by mechanical working. For example, if a magnet having an intrinsic coercivity of 10 kOe in the sintered state is pulverized mechanically, the resulting powder having a grain diameter of between about 20 and 30μ possesses coercivity as low as 1 kOe or less. In the case of mechanically pulverizing a $SmCo_5$ magnet of the type that is considered to have a similar mechanism of coercivity (nucleation model), such a decrease in the intrinsic coercivity does not occur and a powder having sufficient coercivity is easily prepared. This phenomenon arises because the effect of damage and the like caused by the pulverization and working of the R-Fe-B series magnet is much greater. This presents a critical problem in the case of a small magnet such as rotor magnet of a step motor for a watch that is cut from a sintered magnet block.

For the reasons set out above, specifically, that the critical radius is small and the effect of mechanical damage is large, resin-bonded magnets cannot be obtained ordinary pulverization of normal cast alloy ingots or sintered magnetic blocks. In order to obtain powder having sufficient intrinsic coercivity, the powder grains should include a plurality of $R_2Fe_{14}B$ grains as disclosed in the Lee reference. However, the resin-bonding technique of quenched ribbon fragments is not a suitably productive process because of the production of isotropic grains. Furthermore, it is not possible to prepare an acceptable powder of this type by pulverization of a sintered body because the grains become larger during sintering and it is necessary to make the grain diameter prior to sintering smaller than the desired grain diameter. However, if the grain diameter is too small, the oxygen concentration will be extremely high and the performance of the magnet will be far from satisfactory. At present, the permissible grain diameter of the $R_2Fe_{14}B$ compound after sintering is about 10μ. However, the intrinsic coercivity is reduced to almost zero after pulverization.

Preparation of fine grains by hot working has also been observed. It is relatively easy to make $R_2Fe_{14}B$ compound in the molded state having a grain size of about the same size as that prepared by sintering. By performing hot working on a cast alloy ingot having an $R_2Fe_{14}B$ phase having a grain size on the order of the grain size prepared by sintering, the grains can be made fine, aligned and then pulverized. Since the grain diameter of the powder for the resin-bonded magnet is between about 20 and 30 μm, it is possible to include a plurality of $R_2Fe_{14}B$ grains in the powder. This provides a powder having sufficient intrinsic coercivity. Furthermore, the powders obtained are not isotropic like the quenched ribbon fragments prepared in accordance with the Lee reference, and can be aligned in a magnetic field and an anisotropic magnet can be prepared. If the anisotropic grains are pulverized using hydrogen decrepitation, the intrinsic coercivity is maintained even better.

By preparing the permanent magnets in accordance with the invention, the carbon content of the permanent magnet can be less than or equal to 400 ppm and the oxygen content is less than or equal to 1000 ppm. The magnetic performance tends to deteriorate when the carbon and/or oxygen content are outside of these values.

If the crystal grain diameter is less than or equal to about 150 μm a coercive force of at least 4 kOe can be obtained, even after hot working. When the average grain diameter after casting exceeds 150 μm, the coercive force typically does not approach 4 kOe, the minimum coercive force necessary for a practical permanent magnet. The grain diameter can be controlled by varying the cooling temperature, by adjusting the material of the mold, the heat capacity of the mold and the like.

Heat treatment after casting diffuses the iron, which exists as a primary phase in the cast alloy. Iron diffusion in the moten phase eliminates a magnetically soft phase. A similar heat treatment can also be carried out after hot working in order to improve magnetic properties.

Hot working at a temperature greater than or equal to about 500° C., more preferably at a temperature from about 800° to 1100° C. enhances the magnetic properties such as by aligning the crystal axis of the crystal grains so as to make the magnet anisotropic. Hot working also makes the crystal grains finer.

The following working procedures can be used to form magnets in accordance with the invention in order to achieve different desirable properties:

1. hot working followed by a high temperature heat treatment (over 700° C.), preferably in the range of 900° C. to 1100° C. followed by a low temperature heat treatment, preferably in the range 450° to 700° C.
2. hot working followed by a high temperature (900–1050) heat treatment
3. hot working followed by a low temperature heat treatment (450°–700° C.)
4. hot working only
5. high temperature heat treatment only
6. low temperature heat treatment only The invention will be better understood with reference to the following examples. These examples are presented for purposes of illustration only and are not intended to be construed in a limiting sense.

EXAMPLE 1

Reference is made to FIG. 1 which is a flow diagram showing alternate methods of manufacturing a permanent magnet in accordance with the invention. An alloy of the desired composition is melted in an induction furnace and cast into a die. Then, in order to provide anistropy to the magnet, various types of hot working are performed on the samples. For purposes of this example, the Liquid Dynamic Compaction method described in T. S. Chin et al., Journal of Applied Physics, 59(4), p. 1297 (Feb. 15, 1986) was used in place of a general molding method. The liquid dynamic compaction molding method had the effect of making fine crystal grains as if quenching had been used.

Figure 2:
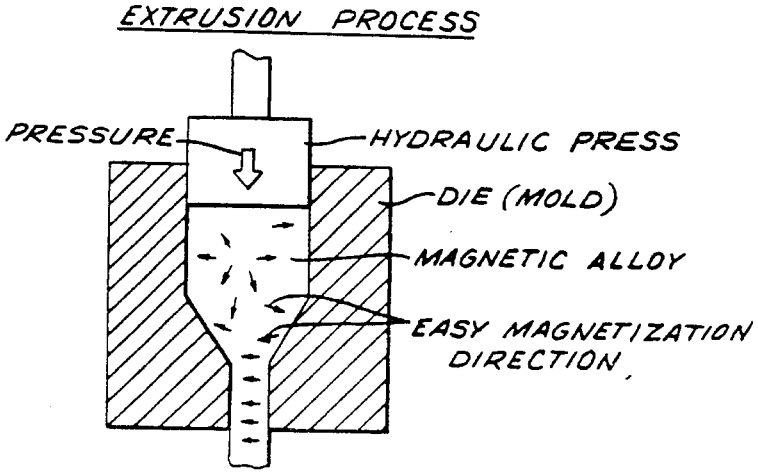
FIG. 2 is a schematic diagram showing anisotropic alignment of a magnetic cast alloy ingot by extrusion.
Figure 3:
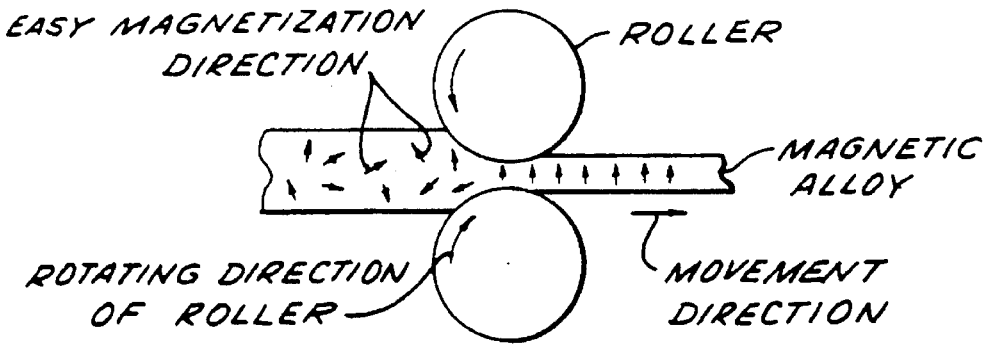
FIG. 3 is a schematic diagram showing anisotropic alignment of a magnetic alloy by rolling.
Figure 4:
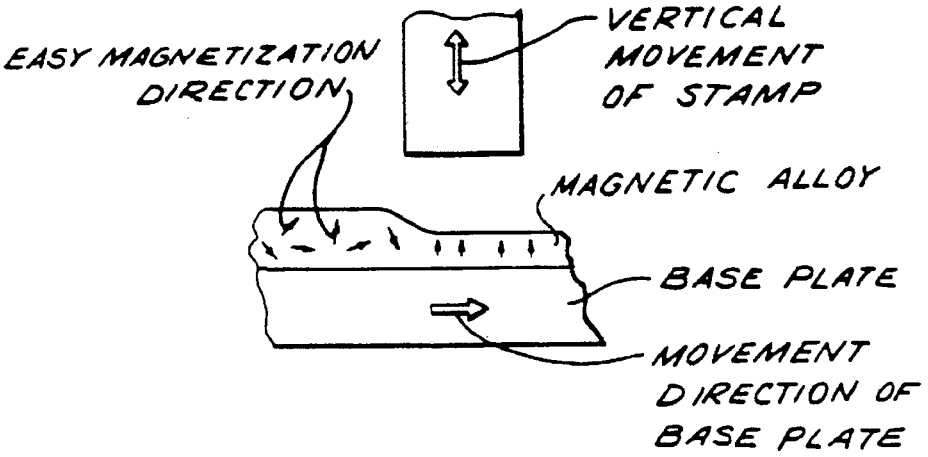
FIG. 4 is a schematic diagram showing anisotropic alignment of a magnetic cast alloy ingot by stamping.

The hot working method used in this Example was an extrusion type as shown in FIG. 2, a rolling type as shown in FIG. 3 or a stamping type as shown in FIG. 4. The hot working method was carried out at a temperature of between about 700° and 800° C.

In order to provide pressure isotactically to the sample in the case of extrusion type molding, a means for applying pressure on the side of the die was provided. In the case of rolling and stamping, the speed of rolling or stamping was adjusted so as to minimize the strain rate. The direction of easy magnetization of the grains were aligned parallel to the direction in which the alloy was urged independent of type of hot working used.

The alloys having compositions shown in Table 1 were melted and made into magnets by the methods shown in FIG. 1. Hot working was applied to each sample as shown in Table 1. Annealing was performed after the hot working at a temperature of 600° C. for 24 hours.

TABLE 1

| No. | Composition | hot working |
|---|---|---|
| 1 | $Nd_8Fe_{84}B_8$ | extrusion |
| 2 | $Nd_{14}Fe_{77}B_8$ | rolling |
| 3 | $Nd_{22}Fe_{68}B_{10}$ | stamping |
| 4 | $Nd_{30}Fe_{55}B_{15}$ | extrusion |
| 5 | $Ce_{3.4}Nd_{5.5}Pr_{5.1}Fe_{75}B_8$ | rolling |
| 6 | $Nd_{17}Fe_{60}Co_{15}B_8$ | stamping |
| 7 | $Nd_{17}Fe_{58}Co_{15}V_2B_8$ | extrusion |
| 8 | $Ce_4Nd_9Pr_4Fe_{55}Co_{15}Al_5B_8$ | rolling |
| 9 | $Ce_3Nd_{10}Pr_4Fe_{56}Co_{15}Mo_4B_8$ | stamping |
| 10 | $Ce_3Nd_{10}Pr_4Fe_{56}Co_{17}Nd_2B_8$ | extrusion |
| 11 | $Ce_3Nd_{10}Pr_4Fe_{54}Co_{17}Tu_2B_{13}$ | rolling |
| 12 | $Ce_3Nd_{10}Pr_4Fe_{52}Co_{17}Ti_2B_{12}$ | stamping |
| 13 | $Ce_3Nd_{10}Pr_4Fe_{50}Co_{17}Zr_2B_{14}$ | extrusion |
| 14 | $Ce_3Nd_{10}Pr_4Fe_{56}Co_{17}Hf_2B_8$ | rolling |

The properties of the resulting magnets are shown in Table 2. For purposes of comparison, residual magnetic flux densities of cast ingots on which hot working was not performed are also shown.

TABLE 2

| | hot working | | | no hot working |
|---|---|---|---|---|
| No. | Br (kG) | iHc (kOe) | (BH)max (MGOe) | Br (kG) |
| 1 | 9.5 | 2.3 | 5.0 | 0.8 |
| 2 | 10.0 | 3.3 | 8.2 | 1.3 |
| 3 | 8.3 | 3.5 | 6.3 | 2.0 |
| 4 | 6.2 | 4.1 | 5.1 | 1.5 |
| 5 | 10.8 | 3.7 | 5.4 | 1.0 |
| 6 | 11.5 | 3.2 | 6.8 | 1.2 |
| 7 | 10.9 | 9.6 | 22.3 | 5.8 |
| 8 | 11.2 | 10.2 | 27.3 | 6.2 |
| 9 | 11.0 | 10.1 | 28.3 | 6.0 |
| 10 | 9.6 | 6.8 | 14.1 | 5.2 |
| 11 | 9.2 | 7.7 | 13.5 | 4.9 |
| 12 | 8.5 | 6.3 | 11.3 | 5.0 |
| 13 | 7.2 | 5.3 | 8.2 | 4.6 |
| 14 | 9.8 | 7.2 | 15.1 | 5.2 |

As can be seen in Table 2, all the hot working techniques such as extrusion, rolling and stamping increased the residual magnetic flux density of the alloy ingot. Accordingly, the samples became magnetically anisotropic.

EXAMPLE 2

This Example illustrates the general casting method of the invention. The alloys of the composition shown in Table 3 were melted in an induction furnace and cast into a die to develop columnar structure.

TABLE 3

| No. | Composition |
|---|---|
| 1 | $Pr_8Fe_{58}B_4$ |
| 2 | $Pr_{14}Fe_{82}B_4$ |
| 3 | $Pr_{20}Fe_{76}B_4$ |
| 4 | $Pr_{25}Fe_{71}B_4$ |
| 5 | $Pr_{14}Fe_{84}B_2$ |
| 6 | $Pr_{14}Fe_{80}B_6$ |
| 7 | $Pr_{14}Fe_{78}B_8$ |
| 8 | $Pr_{14}Fe_{72}Co_{10}B_4$ |
| 9 | $Pr_{14}Fe_{57}Co_{25}B_4$ |
| 10 | $Pr_{14}Fe_{42}Co_{40}B_4$ |
| 11 | $Pr_{14}Dy_2Fe_{91}B_4$ |
| 12 | $Pr_{14}Fe_{80}B_4Si_2$ |
| 13 | $Pr_{14}Fe_{78}Al_4B_4$ |
| 14 | $Pr_{14}Fe_{74}Al_8B_4$ |
| 15 | $Pr_{14}Fe_{70}Al_{12}B_4$ |
| 16 | $Pr_{14}Fe_{67}Al_{15}B_4$ |
| 17 | $Pr_{14}Fe_{78}Mo_4B_4$ |
| 18 | $Nd_{14}Fe_{82}B_4$ |
| 19 | $Ce_3Nd_3Pr_8Fe_{82}B_4$ |
| 20 | $Nd_{14}Fe_{76}Al_4B_4$ |

After carrying out hot working at a thickness reduction of greater than about 50% , an annealing treatment was performed on the ingot at 1000° C. for 24 hours in order to harden the ingot magnetically. After annealing, the mean grain diameter of the sample was about 15 μm.

In the case of a cast magnet, by working the sample in the desired shape without hot working, a plane anisotropic magnet utilizing the anisotropy of the columnar zone was obtained. For resin-bonded magnets, the annealed cast ingot was crushed to fine particles by repeated hydrogen absorption in a hydrogen atmosphere at about 10 atm pressure and hydrogen desorbtion at a pressure of $10^{-5}$ Torr was carried out in an 18-8 stainless steel container at room temperature. The pulverized samples was kneaded with 4 weight percent of epoxy resin and molded in a magnetic field of 10 koe applied perpendicular to the pressing direction. The properties of the resulting magnets are shown in Table 4.

TABLE 4

| | cast type | | | | | |
|---|---|---|---|---|---|---|
| | no hot working | | hot working | | resin-bonded type | |
| No | iHc(kOe) | (BH)max(MGOe) | iHc(kOe) | (BH)max(MGOe) | iHc(Koe) | (BH)max(MGOe) |
| cf | 0.2 | 0.2 | 0.5 | 0.7 | 0.8 | 1.0 |
| 1 | 3.0 | 1.7 | 5.1 | 5.7 | 2.2 | 5.1 |
| 2 | 0.2 | 6.5 | 15.1 | 28.3 | 8.9 | 17.4 |
| 3 | 7.8 | 4.7 | 13.1 | 22.1 | 6.9 | 10.5 |

TABLE 4-continued

| | cast type | | | | | |
|---|---|---|---|---|---|---|
| | no hot working | | hot working | | resin-bonded type | |
| No | iHc(kOe) | (BH)max(MGOe) | iHc(kOe) | (BH)max(MGOe) | iHc(Koe) | (BH)max(MGOe) |
| 4 | 6.5 | 3.8 | 12.1 | 15.7 | 5.0 | 6.1 |
| 5 | 2.5 | 2.0 | 5.1 | 10.7 | 1.2 | 1.3 |
| 6 | 6.0 | 6.2 | 10.4 | 24.2 | 5.1 | 13.8 |
| 7 | 1.0 | 1.2 | 2.0 | 4.3 | 1.4 | 1.2 |
| 8 | 8.7 | 6.0 | 13.4 | 28.0 | 8.0 | 16.6 |
| 9 | 5.9 | 3.5 | 8.1 | 17.4 | 4.0 | 10.0 |
| 10 | 2.5 | 2.3 | 4.0 | 4.6 | 2.1 | 7.1 |
| 11 | 2.0 | 7.0 | 20.0 | 20.8 | 10.5 | 17.8 |
| 12 | 0.0 | 6.0 | 18.3 | 24.5 | 9.5 | 17.1 |
| 13 | 0.9 | 7.1 | 16.7 | 27.4 | 10.9 | 16.4 |
| 14 | 2.0 | 8.1 | 14.3 | 18.0 | 12.0 | 13.4 |
| 15 | 7.0 | 5.0 | 10.3 | 10.5 | 7.5 | 8.2 |
| 16 | 3.5 | 2.5 | 5.0 | 5.1 | 3.7 | 4.0 |
| 17 | 1.0 | 6.9 | 10.7 | 24.3 | 10.0 | 17.3 |
| 18 | 6.7 | 5.4 | 13.1 | 20.8 | 6.7 | 10.8 |
| 19 | 7.5 | 6.4 | 14.5 | 22.1 | 6.8 | 12.8 |
| 20 | 11.0 | 6.9 | 15.3 | 24.1 | 9.7 | 16.0 |

In the case of the cast type magnet, (BH) max and iHc are greatly increased by hot working. This is due to the fact that the grains are aligned and the squareness of the BH curve is improved significantly. By resin-bonding quenched ribbon fragments as shown in the Lee reference, iHc tends to be lowered by hot working. Accordingly, it is a significant advantage of the invention that intrinsic coercivity is improved by hot working.

EXAMPLE 3

This Example shows pulverization and resin-bonding of magnetic anisotropic crystals after hot working. Samples of composition numbers 2 and 8 shown in Table 3 in Example 2 were separately pulverized using a stamping mill and a disc mill. The pulverized grains had a diameter of about 30 μm as measured by a Fischer Subsieve Sizer. The grain diameter of $Pr_2Fe_{14}B$ and $Pr_2(FeCo)_{14}B$ in the pulverized grain was between about 2 and 3 μm.

The powder of sample number 2 was kneaded with 2 weight percent of epoxy resin. The mixture was formed in the magnetic field and the resulting compact was cured.

The powder of composition number 8 was subject to siline coupling reagent treatment and was then kneaded with Nylon 12 to a volume of 40% of the volume of powder. The kneading was carried out at about 280° C. The kneaded powder was then molded using an injection molding method.

The properties of the resulting magnets are shown in Table 5.

TABLE 5

| Sample | Br (kG) | iHc (kOe) | (BH)max (MGOe) |
|---|---|---|---|
| No. 2 | 9.0 | 7.5 | 17.7 |
| No. 8 | 7.1 | 6.9 | 12.0 |

As can be seen, the intrinsic coercivity, iHc is about the same as shown in Example 2 wherein the ingot is pulverizing using hydrogen decrepitation.

EXAMPLE 4

An anisotropic resin-bonded alloy ingot was prepared by a process comprising the steps of melting an alloy, casting the alloy to form an ingot, annealing the ingot at a temperature between about 400° and 1050° C., pulverizing the annealed ingot by hydrogen decrepitation, kneading the pulverized ingot with an organic binder, molding the kneaded powder in a magnetic field and curing the magnet. The alloys shown in Table 6 were melted in an induction furnace.

TABLE 6

| Sample No. | Composition |
|---|---|
| 1 | $Pr_8Fe_{88}B_4$ |
| 2 | $Pr_{14}Fe_{82}B_4$ |
| 3 | $Pr_{20}Fe_{76}B_4$ |
| 4 | $Pr_{25}Fe_{71}B_4$ |
| 5 | $Pr_{14}Fe_{84}B_2$ |
| 6 | $Pr_{14}Fe_{80}B_6$ |
| 7 | $Pr_{14}Fe_{78}B_8$ |
| 8 | $Pr_{14}Fe_{72}Co_{10}B_4$ |
| 9 | $Pr_{13}Dy_2Fe_{81}B_4$ |
| 10 | $Pr_{14}Fe_{80}B_4Si_2$ |
| 11 | $Pr_{14}Fe_{78}Al_4B_4$ |
| 12 | $Pr_{14}Fe_{78}Mo_4B_4$ |
| 13 | $Nd_{14}Fe_{82}B_4$ |
| 14 | $Ce_3Nd_3Pr_8Fe_{82}B_4$ |
| 15 | $Nd_{14}Fe_{78}Al_4B_4$ |

The molten alloys were cast in a mold and the cast ingot was annealed at a temperature between about 400° and 1050° C. in order to magnetically harden the ingot. Annealing was performed at 1000° C. for 24 hours. The binder was used in an amount of about 4 weight percent for each alloy composition. Then the ingot was crushed to fine particles by maintaining the ingot in a hydrogen gas atmosphere at about 30 atmospheric pressure in an 18-8 stainless steel high pressure proof container for about 24 hours. The fine particles were kneaded with an organic binder and molded in a magnetic field. Finally, the mixture was cured.

The results are shown in Table 7. The performance of an alloy of $Nd_{15}Fe_{77}B_8$ prepared using a sintering method is presented for purposes of comparison.

TABLE 7

| | hydrogen decrepitation | | | mechanical grinding (ball-mill) | |
|---|---|---|---|---|---|
| No. | Br (KG) | iHc (kOe) | (BH)max (MGOe) | iHc (kOe) | (BH)max (MGOe) |
| comp | 6.0 | 1.5 | 3.0 | 0.8 | 1.2 |
| 1 | 6.7 | 2.2 | 5.1 | 0.7 | 1.2 |
| 2 | 8.6 | 8.9 | 17.4 | 1.3 | 1.8 |
| 3 | 7.1 | 6.9 | 10.5 | 1.2 | 1.6 |
| 4 | 6.2 | 5.0 | 6.1 | 1.0 | 1.4 |
| 5 | 4.8 | 1.2 | 1.3 | 0.7 | 0.8 |
| 6 | 8.4 | 5.1 | 13.8 | 1.4 | 1.8 |
| 7 | 5.0 | 1.4 | 1.2 | 0.6 | 0.7 |
| 8 | 8.7 | 8.0 | 16.6 | 1.8 | 2.0 |
| 9 | 8.7 | 10.5 | 17.8 | 1.7 | 2.1 |
| 10 | 8.8 | 9.5 | 17.1 | 1.0 | 1.4 |
| 11 | 8.6 | 10.9 | 16.4 | 1.5 | 2.0 |
| 12 | 8.9 | 10.0 | 17.3 | 1.4 | 1.9 |
| 13 | 7.2 | 6.7 | 10.8 | 1.0 | 1.5 |
| 14 | 8.0 | 6.8 | 12.8 | 1.3 | 1.5 |
| 15 | 8.8 | 9.7 | 16.0 | 1.6 | 1.8 |

EXAMPLE 5

An anisotropic cast alloy ingot was prepared by a process comprising the steps of melting an alloy composition, casting the composition to obtain an ingot, hot working the ingot at a temperature greater than about 500° C., annealing the hot worked ingot at a temperature between about 400° and 1050° C. and cutting and polishing the ingot. The alloys of the compositions shown in Table 8 were melted in an induction furnace and cast. Hot working was performed on the cast ingot in order to make the magnet anisotropic. The hot working was either extrusion as shown in FIG. 2. rolling as shown in FIG. 3 or stamping as shown in FIG. 4. The type of hot working is also shown in Table 8.

TABLE 8

| Sample No. | composition | hot working |
|---|---|---|
| 1 | $Pr_8Fe_{88}B_4$ | rolling |
| 2 | $Pr_{14}Fe_{82}B_4$ | rolling |
| 3 | $Pr_{20}Fe_{76}B_4$ | rolling |
| 4 | $Pr_{25}Fe_{71}B_4$ | rolling |
| 5 | $Pr_{14}Fe_{84}B_2$ | rolling |
| 6 | $Pr_{14}Fe_{80}B_6$ | rolling |
| 7 | $Pr_{14}Fe_{78}B_8$ | rolling |
| 8 | $Pr_{14}Fe_{72}Co_{10}B_4$ | extrusion |
| 9 | $Pr_{13}Dy_2Fe_{81}B_4$ | extrusion |
| 10 | $Pr_{14}Fe_{80}B_4Si_2$ | extrusion |
| 11 | $Pr_{14}Fe_{78}Al_4B_4$ | extrusion |
| 12 | $Pr_{14}Fe_{78}Mo_4B_4$ | extrusion |
| 13 | $Nd_{14}Fe_{82}B_4$ | stamping |
| 14 | $Ce_3Nd_3Pr_8Fe_{82}B_4$ | stamping |
| 15 | $Nd_{14}Fe_{78}Al_4B_4$ | stamping |

The direction of easy magnetization of the grain was aligned parallel to the pressing direction regardless of the hot working process that was used.

Hot working was performed at a temperature between about 700° and 800° C. and annealing was performed at a temperature of 1000° C. for a period of 24 hours. The magnetic properties of the magnets obtained are shown in Table 9.

TABLE 9

| | hot working performed | | | hot working not performed | |
|---|---|---|---|---|---|
| No | Br (KG) | iHc (kOe) | (BH)max (MGOe) | Br (KG) | (BH)max (MGOe) |
| 1 | 9.4 | 2.5 | 5.0 | 3.8 | 1.7 |
| 2 | 11.0 | 10.0 | 28.5 | 6.0 | 6.5 |
| 3 | 9.8 | 7.3 | 18.1 | 5.1 | 4.7 |
| 4 | 8.0 | 6.2 | 15.0 | 4.4 | 2.8 |
| 5 | 5.5 | 1.6 | 5.9 | 4.4 | 2.0 |
| 6 | 10.2 | 5.5 | 23.7 | 6.2 | 6.2 |
| 7 | 7.8 | 1.2 | 6.5 | 4.6 | 2.3 |
| 8 | 10.5 | 8.1 | 27.4 | 6.0 | 6.0 |
| 9 | 10.7 | 12.0 | 26.2 | 6.4 | 7.0 |
| 10 | 10.8 | 10.6 | 28.3 | 6.1 | 6.0 |
| 11 | 10.5 | 11.8 | 25.0 | 6.3 | 7.1 |
| 12 | 10.4 | 11.6 | 24.8 | 6.5 | 6.9 |
| 13 | 9.5 | 6.2 | 17.4 | 6.4 | 6.4 |
| 14 | 9.9 | 7.3 | 18.7 | 6.4 | 6.4 |
| 15 | 10.5 | 10.4 | 24.2 | 6.5 | 6.9 |

EXAMPLE 6

Permanent magnets containing rare earth elements, iron and boron as primary ingredients having specified compositions are shown in Table 10.

TABLE 10

| Sample No. | Composition | | | | |
|---|---|---|---|---|---|
| 1 | $Nd_{15}$ | $Fe_{77}$ | $B_8$ | | |
| 2 | $Nd_{15}$ | $Fe_{80}$ | $B_5$ | | |
| 3 | $Pr_{16}$ | $Fe_{80}$ | $B_4$ | | |
| 4 | $Pr_{16}$ | $Fe_{81.5}$ | $B_{2.5}$ | | |
| 5 | $Pr_{17}$ | $Fe_{77}$ | $B_6$ | | |
| 6 | $Ce_2$ | $Nd_5$ | $Pr_{10}$ | $Fe_{79}$ | $B_4$ |
| 7 | $Nd_{10}$ | $Pr_7$ | $Fe_{70}$ | $Co_5$ | $B_8$ |
| 8 | $Nd_5$ | $Pr_{12}$ | $Fe_{76}$ | $Al_3$ | $B_4$ |
| 9 | $Nd_{20}$ | $Dy_2$ | $Fe_{70}$ | $Co_2$ | $B_6$ |
| 10 | $Pr_{10}$ | $Tb_2$ | $Fe_{74}$ | $Co_2$ | $Al_2$ $B_{10}$ |

Alloys having the compositions in Table 10 were melted in an induction furnace under an argon atmosphere and cast into various iron molds at a temperature of 1500 C. The rare earth metals had a purity of 95% with the 5% impurities arising primarily from the presence of other rare earth metals. The transition metals had a purity of greater than or equal to about 99.9% and ferro-boron alloy was used to introduce the boron. The cast ingots were removed form the molds 20 minutes after casting.

The cast alloys were subjected to heat treatment at a temperature of 1000° C. for 24 hours, then cut and ground to obtain a permanent magnet. The magnetic performance and average grain diameter of the magnets obtained is shown in Table 11.

TABLE 11

| Sample No. | Coercive Force IHc (kOe) | Average grain diameter (μm) |
|---|---|---|
| 1 | 5.1 | 100 |
| 2 | 5.7 | 80 |
| 3 | 7.7 | 30 |
| 4 | 6.5 | 23 |
| 5 | 6.3 | 65 |
| 6 | 7.3 | 33 |
| 7 | 5.9 | 67 |
| 8 | 8.0 | 28 |

TABLE 11-continued

| Sample No. | Coercive Force IHc (kOe) | Average grain diameter (μm) |
|---|---|---|
| 9 | 4.4 | 47 |
| 10 | 1.1 | 150 |

Figure 5:
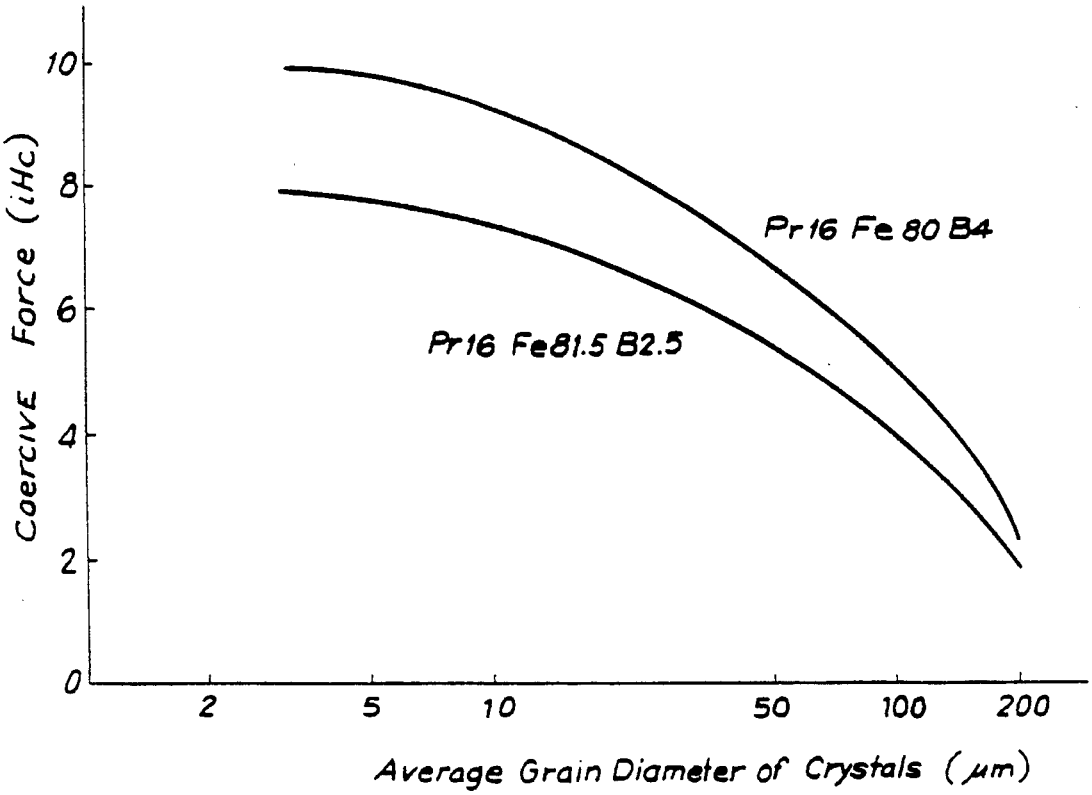
FIG. 5 is a graph showing force as a function of average grain diameter after hot working a magnet in accordance with an embodiment of the invention.

The relationship between the coercive force (iHc) after hot pressing sample numbers 3 and 4 as a function of average grain diameter (μm) is shown in the FIG. 5. The grain diameter was controlled using water-cooled copper molds, iron molds and ceramic molds and by vibrating the molds. As can be seen, it is possible to prepare a cast permanent magnet when the grain diameter is controlled.

EXAMPLE 7

Permanent magnets were prepared using the compositions shown in Table 12.

TABLE 12

| Sample No. | Composition | | | | | | | | |
|---|---|---|---|---|---|---|---|---|---|
| 11 | $Pr_{17}$ | $Fe_{79}$ | $B_4$ | | | | | | |
| 12 | $Pr_{14}$ | $Dy_2$ | $Fe_{79}$ | $B_5$ | | | | | |
| 13 | $Pr_{13}$ | $Nd_4$ | $Fe_{74}$ | $Co_5$ | $B_4$ | | | | |
| 14 | $Pr_{16}$ | $Fe_{70}$ | $Co_5$ | $Al_3$ | $B_6$ | | | | |
| 15 | $Nd_{13}$ | $Tb_2$ | $Fe_{66}$ | $Co_{10}$ | $Al_5$ | $B_4$ | | | |
| 16 | $Ce_2$ | $Pr_{13}$ | $Nd_2$ | $Fe_{61}$ | $Co_5$ | $Cr_1$ | $Zr_1$ | $Ti_1$ | $B_4$ |

Each composition was cast into a water-cooled copper mold in the manner described in Example 6. The cast ingots were hot pressed at 1000° C. to make the permanent magnets anisotropic. The average diameter and magnetic performance after heat treatment and the average diameter and magnetic performance after hot pressing are shown in Table 13.

TABLE 13

| | After casting | | | After Hot Pressing | | |
|---|---|---|---|---|---|---|
| Sample No. | Average Grain Diameter (μm) | iHc (KOe) | (BH) max (MGOe) | Average Grain Diameter (μm) | iHc (kOe) | (OH)max(MG Oe) |
| 11 | 15 | 8.8 | 5.8 | 10 | 10.5 | 24.6 |
| 12 | 30 | 7.7 | 4.8 | 20 | 8.8 | 21.3 |
| 13 | 23 | 8.0 | 5.5 | 13 | 9.0 | 23.8 |
| 14 | 40 | 6.7 | 4.7 | 28 | 7.0 | 20.2 |
| 15 | 75 | 5.8 | 3.1 | 45 | 6.8 | 18.5 |
| 16 | 20 | 8.0 | 5.3 | 10 | 9.7 | 21.4 |

The magnetic properties of Sample Numbers 11, 13 and 14 after hot pressing followed by 24 hour heat treatment at 1000° C. are shown in Table 14.

TABLE 14

| Sample No. | Average Grain Diameter (μm) | iHc (kOe) | Br (KG) | (BH) max (MGOe) |
|---|---|---|---|---|
| 11 | 10 | 11.0 | 11.0 | 25.1 |
| 13 | 13 | 9.5 | 10.4 | 24.3 |
| 14 | 28 | 8.0 | 10.2 | 22.4 |

As can be seen, hot working decreases the grain diameter and enhances the magnetic performance. The magnetic performance is also improved by heat treatment. Even though the magnets were prepared by casting, the carbon content was less than or equal to about 400 ppm and the oxygen content was less than or equal to about 1000 ppm.

A coercive force is provided in a bulk state cast ingot without the need for pulverizing the ingot by using a manufacturing method in accordance with the invention. The ingot is cast so that the average grain diameter is less than or equal to about 150 μm, the carbon content is less than or equal to about 400 ppm and the oxygen content is less than or equal to about 1000 ppm. The cast ingot can be hot worked at a temperature greater than or equal to about 500° C. to provide anistropy to the magnet. Alternatively, the magnet can be heat treated at a temperature greater than or equal to about 250° C. without hot processing or after hot processing. Accordingly, manufacturing is greatly simplified and the manufacture of high performance, low cost permanent magnetic alloys is possible.

It will thus be seen that the objects set forth above, among those made apparent from the preceding description, are efficiently attained and, since certain changes may be made in carrying out the above process and in the article set forth without departing from the spirit and scope of the invention, it is intended that all mater contained in the above description and shown in the accompanying drawing shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

Particularly, it is to be understood that in said claims, ingredients or compounds recited in the singular are intended to include compatible mixtures of such ingredients wherever the sense permits.

We claim:

1. A rare earth-iron permanent magnet comprising a cast alloy ingot of between about 8 to 30 atomic percent of at least one rare earth element, between about 2 and 8 atomic percent boron and the balance iron, the alloy prepared by melting the components and forming a cast alloy ingot and then performing at least one of heat treating at a temperature above about 250° C. and hot working the ingot at a temperature above about 500° C., the ingot having an average grain diameter of from about 3 to about 150 microns, a carbon content of less than or equal to about 400 ppm and an oxygen content of less than or equal to about 1000 ppm.

2. The rare earth-iron permanent magnet of claim 1, wherein the rare earth element is selected from the group consisting of yttrium, lanthanum, cerium, praseodymium, neodymium, promethium, samarium, europium, gadolinium, terbium, dysprosium, holmium, erbium, thulium, ytterbium, lutetium and mixtures thereof.

3. The rare earth-iron permanent magnet of claim 2, further including an effective amount of at least one member selected from the group of aluminum, chromium, molybdenum, tungsten, niobium, tantalum, zirconium, hafnium, titanium and mixtures thereof for enhancing the coercive force of the magnet.

4. The rare earth-iron permanent magnet of claim 3, further including an effective amount of cobalt for increasing the Curie temperature of the magnet.

5. The rare earth-iron permanent magnet of claim 1, wherein the rare earth element is selected from the group consisting of neodymium, praseodymium and mixtures thereof.

6. The rare earth-iron permanent magnet of claim 1, further including an effective amount of cobalt for increasing the Curie temperature of the magnet.

7. The rare earth-iron permanent magnet of claim 6, wherein the cobalt is present in an amount up to about 40 atomic %.

8. The rare earth-iron permanent magnet of claim 6, wherein the cast ingot is heat treated.

9. The rare earth-iron permanent magnet of claim 6, wherein the cast ingot is heat treated and hot worked.

10. The rare earth-iron permanent magnet of claim 6, wherein the cast ingot is hot worked.

11. The rare earth-iron permanent magnet of claim 1, further including an effective amount of at least one member selected from the group of aluminum, chromium, molybdenum, tungsten, niobium, tantalum, zirconium, hafnium, titanium and mixtures thereof for enhancing the coercive force of the magnet.

12. The rare earth-iron permanent magnet of claim 11, further including an effective amount of cobalt for increasing the Curie temperature of the magnet.

13. The rare earth-iron permanent magnet of claim 1, further including an effective amount of aluminum for enhancing the coercive force of the magnet.

14. The rare earth-iron permanent magnet of claim 1, wherein the cast ingot is heat treated.

15. The rare earth-iron permanent magnet of claim 1, wherein the cast ingot is heat treated and hot worked.

16. The rare earth-iron permanent magnet of claim 1, wherein the cast ingot is hot worked.

17. The rare earth-iron series permanent magnet of claim 1, wherein the average grain size of the cast ingot is between about 3 to about 100 microns.

18. The rare earth-iron series permanent magnet of claim 1, wherein the average grain size of the cast ingot is between about 15 to about 75 microns.

19. A rare earth-iron permanent magnet comprising:

an alloy of at lest one rare earth element in an amount between about 8 and 30 atomic %;

boron in an amount between about 2 and 28 atomic %;

an effective amount of cobalt for increasing the Curie temperature of the magnet;

a minimum effective amount to about 5 atomic percent of at least one coercive force enhancing member selected from the group of aluminum, chromium, molybdenum, tungsten, niobium, tantalum, zirconium, hafnium, titanium, and mixtures thereof for enhancing the coercive force of the magnet;

the balance of iron; and wherein the magnet is prepared by melting the components and casting the melt to provide a cast alloy ingot and performing at least one of heat treating the ingot at a temperature above about 250° C. and hot working the ingot at a temperature above about 500° C., the ingot having an average grain diameter of from about 3 to about 150 microns, a carbon content of less than or equal to about 400 ppm and an oxygen content of less than or equal to about 1000 ppm and the magnet prepared by heating the cast alloy.

20. The rare earth-iron series permanent magnet of claim 19, wherein the average grain size of the cast ingot is between about 3 to about 100 microns.

21. The rare earth-iron series permanent magnet of claim 19, wherein the average grain size of the cast ingot is between about 15 to about 75 microns.

22. A rare earth permanent magnet having a crystal grain with an average diameter of about 3 to 150 μm, a carbon content of less than or equal to about 400 ppm and an oxygen content of less than or equal to about 1000 ppm. prepared by:

casting a rare earth-iron melt to make an alloy comprising between about 8 and 30 atomic percent of at least one rare earth element, between about 2 and 28 atomic percent of boron, iron and other impurities that are inevitably included during the preparation process;

casting the melt to obtain a cast alloy ingot; and hot working the ingot at a temperature greater than about 500° C. to make the ingot magnetically anisotropic.

23. The magnet of claim 22, which has been heat treated at a temperature above about 250° C. after hot working.

24. The magnet of claim 22, wherein the hot worked ingot is milled to obtain a powder having a grain diameter between about 10 and 30 μm, an organic binder is kneaded with the powder and the mixture of powder and binder is cured to yield a resin-bonded magnet.

25. The magnet of claim 24, wherein each grain of the resin-bonded magnet includes a plurality of anisotropic $R_2Fe_{14}B$ grains.

26. The magnet of claim 22, including between 0 and 15 atomic percent aluminum.

27. The magnet of claim 22, including between 0 and 15 atomic percent of aluminum, 2 and 8 atomic percent of boron and less than 50 atomic percent of cobalt.

28. The magnet of claim 22, wherein the ingot is heat treated at a temperature between about 800° and 1100° C. after hot working.

29. The magnet of claim 22, wherein the hot worked ingot is heat treated at a temperature between 900° and 1050° C., followed by a heat treatment at a temperature from 480° to 700° C.

30. The magnet of claim 22, wherein the hot worked ingot is heat treated at a temperature from 450° to 700° C.

31. The magnet of claim 22, wherein hot working is carried out at a temperature from about 700° to 1100° C.

32. The magnet of claim 22, including a member selected from the group consisting of Pr, Nd, Pr-Nd alloy, Ce-Pr-Nd alloy, and combinations thereof.

33. The magnet of claim 22, wherein the alloy has the phase $Pr_2Fe_{14}B$.

34. A rare earth permanent magnet, prepared by:

casting a rare earth-iron melt to make an alloy comprising between about 8 and 30 atomic percent of at least one rare earth element, between about 2 and 28 atomic percent of boron, iron and other impurities that are inevitably included during the preparation process;

casting the melt to obtain a cast alloy ingot; hot working the ingot at a temperature greater than about 500° C.; and heat treating the cast alloy ingot at a temperature between about 800° and 1100° C.

* * * * *